US009895042B2

(12) United States Patent
Matsushita

(10) Patent No.: US 9,895,042 B2
(45) Date of Patent: Feb. 20, 2018

(54) REMOVER COVER

(71) Applicant: MTG Co., Ltd., Nagoya-shi (JP)

(72) Inventor: Tsuyoshi Matsushita, Aichi (JP)

(73) Assignee: MTG Co., Ltd., Nagoya-shi (JP)

( * ) Notice: Subject to any disclaimer, the term of this patent is extended or adjusted under 35 U.S.C. 154(b) by 300 days.

(21) Appl. No.: 14/420,006

(22) PCT Filed: Dec. 14, 2012

(86) PCT No.: PCT/JP2012/082455

§ 371 (c)(1),
(2) Date: Feb. 6, 2015

(87) PCT Pub. No.: WO2014/024334

PCT Pub. Date: Feb. 13, 2014

(65) Prior Publication Data

US 2015/0216287 A1 Aug. 6, 2015

(30) Foreign Application Priority Data

Aug. 10, 2012 (JP) ..... 2012-178650

(51) Int. Cl.
*A47L 13/16* (2006.01)
*A45D 44/00* (2006.01)

(52) U.S. Cl.
CPC ..... *A47L 13/16* (2013.01); *A45D 44/00* (2013.01); *A45D 2200/1063* (2013.01)

(58) Field of Classification Search
CPC ..... A47L 13/20; A47L 13/38; A47L 13/16; A47L 13/28; A45D 2200/1081
USPC ..... 15/227, 247, 208–210.1
See application file for complete search history.

(56) References Cited

U.S. PATENT DOCUMENTS 981,192 A * 1/1911 Hollingshead ..... A47L 13/18 15/210.1
4,071,921 A * 2/1978 Jury ..... A41D 13/082 15/227
5,953,784 A 9/1999 Suzuki et al.
(Continued)

FOREIGN PATENT DOCUMENTS

CN 2587431 Y 11/2003
CN 201585931 U 9/2010
(Continued)

OTHER PUBLICATIONS

Office Action dated Aug. 25, 2015 in Japanese Patent Application No. 2012-178650 (with English language translation).
(Continued)

*Primary Examiner* — Laura C Guidotti
(74) *Attorney, Agent, or Firm* — Oblon, McClelland, Maier & Neustadt, L.L.P.

(57) ABSTRACT

A remover cover is detachably attached to an attraction head equipped at one end of a substantially rod-shaped remover. The attraction head includes a magnetic force generating surface adapted to generate a magnetic force. The cover includes a cover body shaped like a bag and adapted to cover the remover from a tip of the attraction head to at least the magnetic force generating surface, and a holding portion installed by extending from an open end of the cover body. The cover body is configured to allow itself to be turned inside out.

12 Claims, 4 Drawing Sheets

(56) References Cited

U.S. PATENT DOCUMENTS

| | | | | |
|---|---|---|---|---|
| 7,181,800 | B2 * | 2/2007 | Lee | A46B 7/04 15/147.1 |
| 2005/0120497 | A1 * | 6/2005 | Lynde | A47L 13/20 15/104.94 |
| 2015/0216287 | A1 | 8/2015 | Matsushita | |

FOREIGN PATENT DOCUMENTS

| | | | |
|---|---|---|---|
| CN | 203446808 | U | 2/2014 |
| JP | 3-234206 | A | 10/1991 |
| JP | 9-154791 | A | 6/1997 |
| JP | 2002-330891 | A | 11/2002 |
| JP | 2003-199620 | A | 7/2003 |
| JP | 2003-289940 | A | 10/2003 |
| JP | 2003-339437 | A | 12/2003 |
| JP | 2004-187874 | A | 7/2004 |
| JP | 2004-248510 | A | 9/2004 |
| JP | 2005-312497 | A | 11/2005 |
| JP | 3115321 | U | 11/2005 |
| JP | 3193185 | U | 8/2014 |
| KR | 20-0336700 | | 12/2003 |

OTHER PUBLICATIONS

"Science Window," Japan Science and Technology Agency, Media Section of Department for Science and Technology Program Promotion, vol. 1, No. 9, 2007, 4 Pages.

Combined Office Action and Search Report dated Mar. 9, 2016 in Taiwanese Patent Application No. 102100406 (with English language translation and English Translation of Category of Cited Documents).

Chinese Search Report dated Aug. 4, 2015 in Patent Application No. 201310048324.8 (with English Translation of Category of Cited Documents).

Japanese Office Action dated Jun. 30, 2015 in Patent Application No. 2012-178650 (with English Translation).

Korean Office Action dated Apr. 9, 2015 in Patent Application No. 10-2015-7006057 (with English Translation).

International Search Report dated Mar. 19, 2013 in PCT/JP2012/082455 Filed Dec. 14, 2012.

* cited by examiner

REMOVER COVER

TECHNICAL FIELD

The present invention relates to a remover cover which is attached to a remover adapted to remove a paste-like cosmetic agent using magnetic attraction.

BACKGROUND ART

Paste-like cosmetic agents used for cosmetic purposes are roughly classified into those which come into a film-like state some time after application and those which maintain a paste-like state even after a passage of time. The cosmetic agent which comes into a film-like state after application can be separated easily from skin by gripping part of the film and stripping away. On the other hand, regarding methods for removing the cosmetic agent which maintains a paste-like state after application from skin after use, it is common practice to wipe off the cosmetic agent with cotton or the like or wash off the cosmetic agent with lukewarm water or the like. Recently, there has been demand for a method which can remove cosmetic agents after use more simply and easily than can these common methods.

For example, as disclosed in Patent Document 1 and Patent Document 2, a method is proposed which uses a cosmetic agent mixed with iron powder and a remover whose main body contains a magnet in combination. In the removers described in Patent Document 1 and Patent Document 2 the magnet in the main body is covered with a cap to allow the iron powder in the cosmetic agent to be attracted to a surface of the cap by a magnetic force of the magnet.

Also, in these removers, the cap is provided slidably, making a distance between the cap and magnet variable. Consequently, after the iron powder with the used cosmetic agent is caused to be attracted to the cap, by sliding the cap in a direction away from the magnet and thereby weakening a magnetic force acting on the iron powder, it can be made easy to remove the iron powder and the cosmetic agent attached thereto from the cap.

PRIOR ART DOCUMENT

Patent Documents

Patent Document 1: JP-A-2005-312497
Patent Document 2: JP-A-2004-187874

SUMMARY OF THE INVENTION

Problem to be Solved by the Invention

The removers described in Patent Document 1 and Patent Document 2 make it possible to weaken the magnetic force acting on the iron powder by sliding the cap away from the magnet. Consequently, whereas the iron powder can be dropped easily by sliding the cap, if the cap is slid unexpectedly, the attracted iron powder could inadvertently fall off from the cap, thereby being scattered. Accordingly, the removers are not easy to use.

The present invention has been made in view of the background described above and is intended to provide a cover which can easily suppress scattering of a cosmetic agent.

Solution to the Problems

One aspect of the present invention resides in a remover cover detachably attached to an attraction head equipped at one end of a substantially rod-shaped remover, the attraction head having a magnetic force generating surface adapted to generate a magnetic force, the remover cover including:

a cover body shaped like a bag and adapted to cover the remover from a tip of the attraction head to at least the magnetic force generating surface; and a holding portion installed by extending from an open end of the cover body, wherein the cover body is configured to allow itself to be turned inside out.

Advantageous Effects of the Invention

The cover is attached to the remover by inserting the attraction head in the baglike cover body. Consequently, the cover body is placed so as to cover the magnetic force generating surface as described above. Thus, when the attraction head of the remover to which the cover is attached is brought close to a skin surface applied a cosmetic agent attractable by the magnetic force, the cosmetic agent is attracted to a surface of the cover which covers the magnetic force generating surface by the magnetic force.

Various methods are available for disposal of the cosmetic agent attracted to the surface of the cover. For example, the following method can be employed.

After the use of the remover, the cover body is held between the attracted cosmetic agent and magnetic force generating surface by the magnetic force and kept in contact with the magnetic force generating surface of the attraction head. In this state, a user of the remover folds back the holding portion toward a tip side of the attraction head with the magnetic force generating surface turned up.

Next, the user displaces the holding portion in a direction of the tip of the attraction head and turns the cover body inside out by stripping the cover body from the attraction head. Consequently, the attracted cosmetic agent is gathered in a fold formed between that part of the cover body which has been stripped from the attraction head and that part of the cover body which is in contact with the magnetic force generating surface.

Then, when the user finishes turning the cover body inside out by continuing to displace the holding portion in the direction of the tip of the attraction head, the cosmetic agent is received in the cover body. Thus, the cover can suppress leakage of the cosmetic agent from the cover and direct attraction to the attraction head when the cover is stripped from the attraction head. Also, the cosmetic agent received in the cover body in this way can be discarded at a disposal site for the cosmetic agent with being contained in the cover.

In this way, the cover can be detachably attached to the attraction head and is shaped like a bag capable of being turned inside out. This makes it possible, as described above, to suppress inadvertent scattering such that the cosmetic agent removed from skin by the remover leaks out of the cover and improve the ease of use of the remover.

DESCRIPTION OF THE PREFERRED EMBODIMENTS

Figure 1:
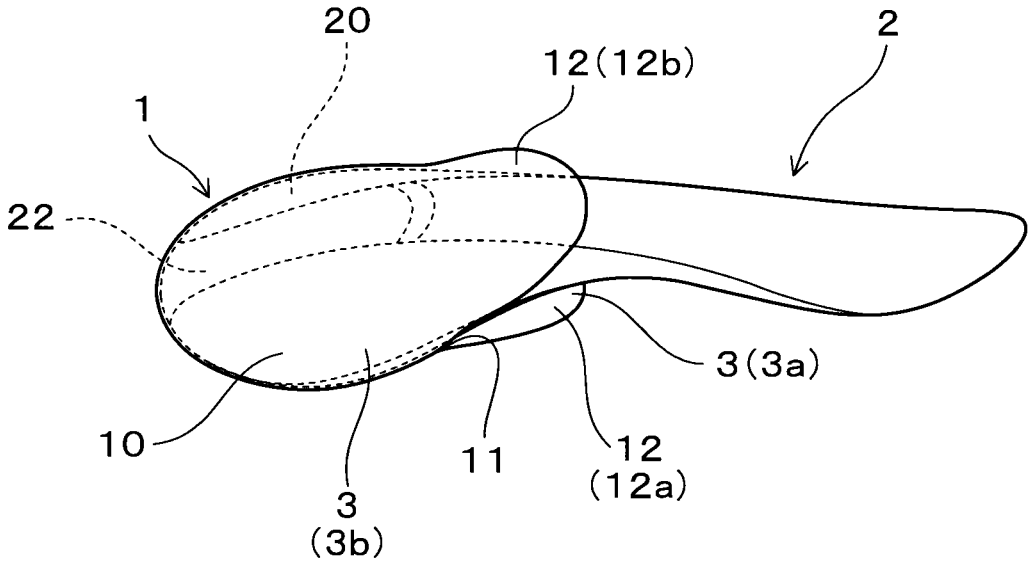
FIG. 1 is a perspective view showing a cover attached to a remover according to Example 1.

In the remover cover, preferably the cover body has stretchability and is configured to become stretched when the attraction head is covered. That is, when attached to the attraction head, the cover body is preferably more stretched along an external shape of the attraction head than in natural state. In this case, the cover body is shaped to conform to the external shape of the attraction head, making it less likely that gaps will be formed between the cover body and attraction head due to creases or the like. Thus, the cover can suppress weakening of the magnetic force acting on the cosmetic agent by gaps described above and make the cosmetic agent attracted reliably.

Also, the cover body may have an inner surface made up of a convexo-concave surface and an outer surface made up of a smooth surface. In this case, the cover has a relatively small contact area between the inner surface of the cover body and the attraction head. This allows the cover body to appropriately reduce frictional forces when the attraction head is inserted. Consequently, the cover can be attached to the attraction head more easily.

Also, the convexo-concave surface may be formed on the holding portion. In this case, when the user grips the holding portion, fingers of the user are less likely to slip over the holding portion, making the cover easier to use.

Also, the attraction head that is covered by the cover body may include a bulging portion bulged out in a direction substantially orthogonal to a longitudinal direction of the remover and the magnetic force generating surface may be provided on top part of the bulging portion. In this case, it is easier to increase area of the magnetic force generating surface on the remover than when the magnetic force generating surface is formed on a tip surface of the remover in the longitudinal direction. This increases an amount of cosmetic agent attracted by the magnetic force generating surface. Thus, the use of the remover cover for the remover makes it possible to effectively provide the effect of preventing inadvertent scattering of the cosmetic agent.

Also, the remover cover may be formed by laying two sheets one on top of the other and joining part of peripheries of the sheets. In this case, the cover can have an advantage in terms of cost by using sheets available at low cost. Also, by joining two sheets, it is possible to simplify a step of forming a baglike structure compared to other forming methods such as vacuum forming or compression molding. This results in a reduced price and more increased productivity of the cover.

In this case, a material of the sheets can be selected appropriately from among known materials which lend itself to being turned inside out. For example, cloth materials, various resins formed into a film such as polyethylene, polypropylene, nylon, polyvinyl alcohol, urethane, and silicone can be employed. For example, in the case of polyethylene, a film from 0.02 to 0.2 mm in thickness can be used.

Also, in this case, to join together the two sheets, known methods can be used, such as adhesive bonding or thermo-compression bonding.

Also, each of the two sheets may be shaped as a connection of a main body region which is to become the cover body and a holding region which is to become the holding portion and only outer peripheries of the main body regions may be joined together and two of the holding portions may be provided. In this case, the cover can be turned inside out more easily when stripped from the attraction head by displacing each of the two holding portions in the direction of the tip of the attraction head. This makes the cover easier to use.

Also, the holding regions of the two sheets may have a same shape. In this case, since the two sheets have the same shape, it is easy to further improve production efficiency of the cover.

Also, one of the two sheets may be shaped as a connection of a main body region which is to become the cover body and a holding region which is to become the holding portion while the other sheet may be shaped to have only a main body region such as described above, and only outer peripheries of the main body regions may be joined together and one of the holding portion may be provided. If at least one holding portion is disposed on the cover, the cover body can be turned inside out as described above.

Also, the outer peripheries of the main body regions of the two sheets may be arc-shaped. In this case, when the cover is attached to the attraction head, turned inside out, or the like, the cover is shaped such that stresses resulting from deformation of the cover are less likely to concentrate on a joining area of the sheets. Thus, when the cover is attached to the attraction head, detached from the attraction head, or the like, the cover is less likely to being torn and less likely to leakage of the cosmetic agent.

EXAMPLES

Example 1

Figure 2:
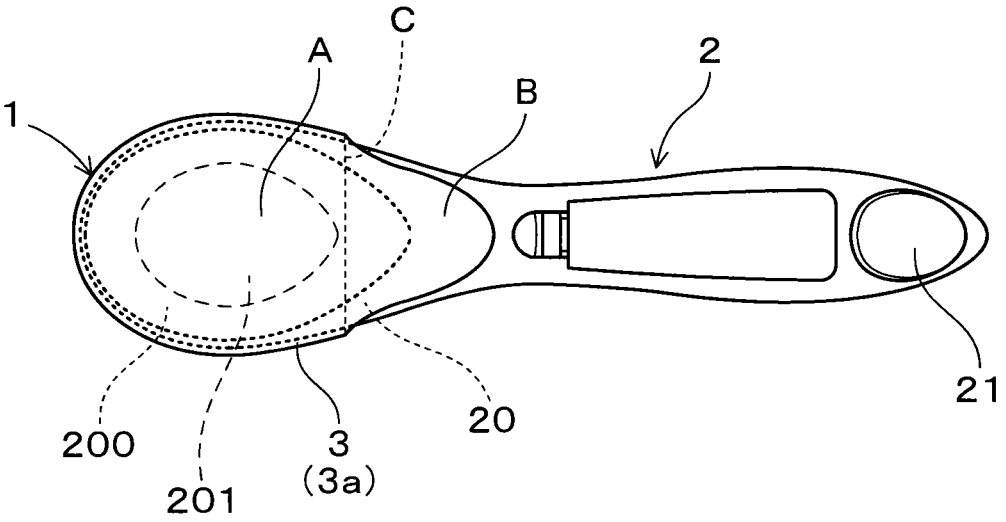
FIG. 2 is a plan view of the remover with the cover attached thereto as viewed from the side of a magnetic force generating surface (from below) according to Example 1.

An example of the remover cover will be described with reference to FIG. 1 to FIG. 5. As shown in FIG. 1, FIG. 2, and FIG. 5, a remover cover 1 is detachably attached to an attraction head 20 equipped at one end of a substantially rod-shaped remover 2. The attraction head 20 includes a magnetic force generating surface 201 adapted to generate a magnetic force. As shown in FIG. 1 and FIG. 2, the cover 1 includes a cover body 10 shaped like a bag and adapted to cover the remover from a tip of the attraction head 20 to at least the magnetic force generating surface 201, and holding portions 12 installed by extending from an open end 11 of the cover body 10. As shown in FIG. 5, the cover 1 is configured to allow itself to be turned inside out.

Figure 3:
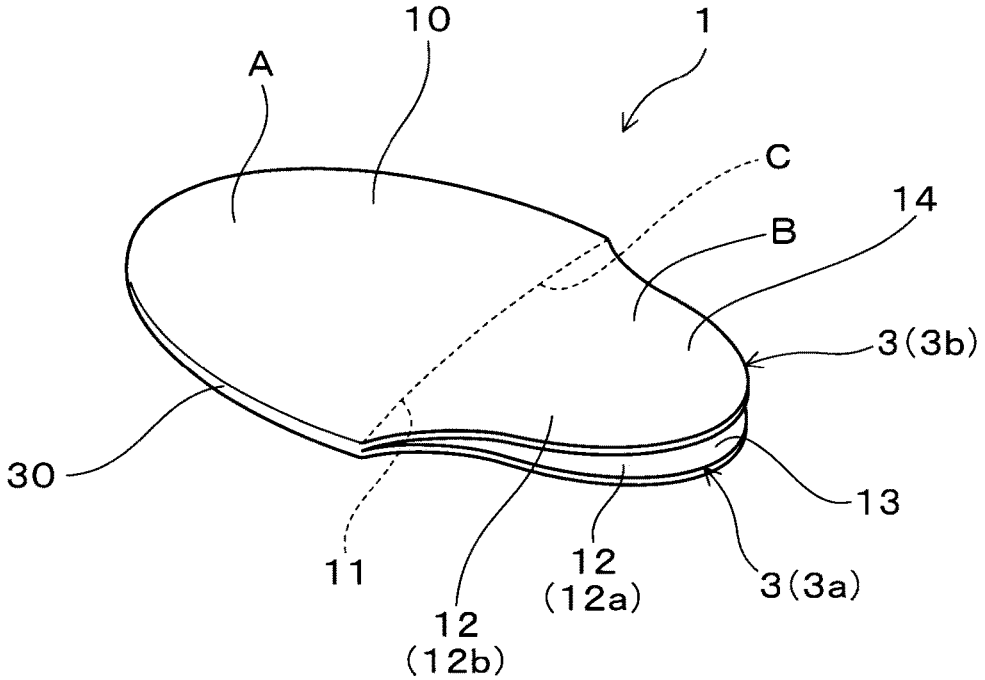
FIG. 3 is a perspective view of the cover according to Example 1.
Figure 4:
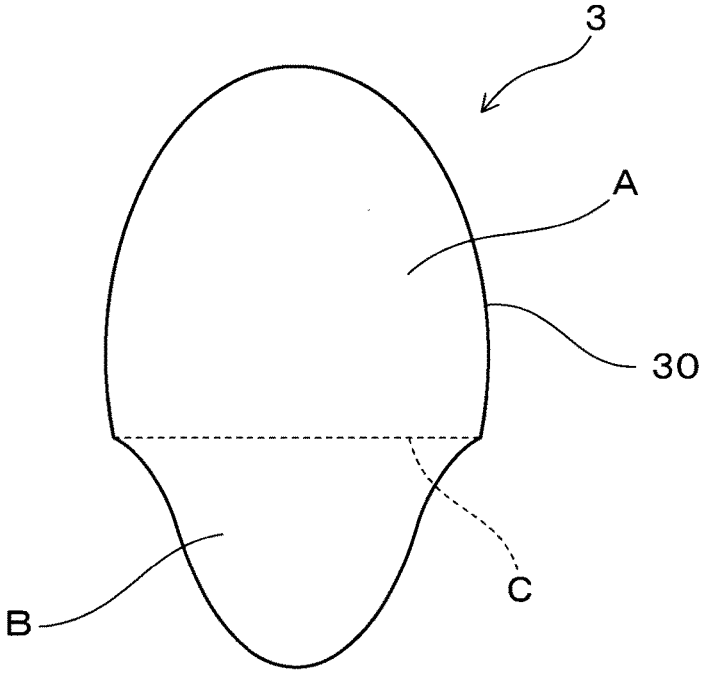
FIG. 4 is a plan view of a sheet as viewed from a thickness direction according to Example 1.
Figure 5:
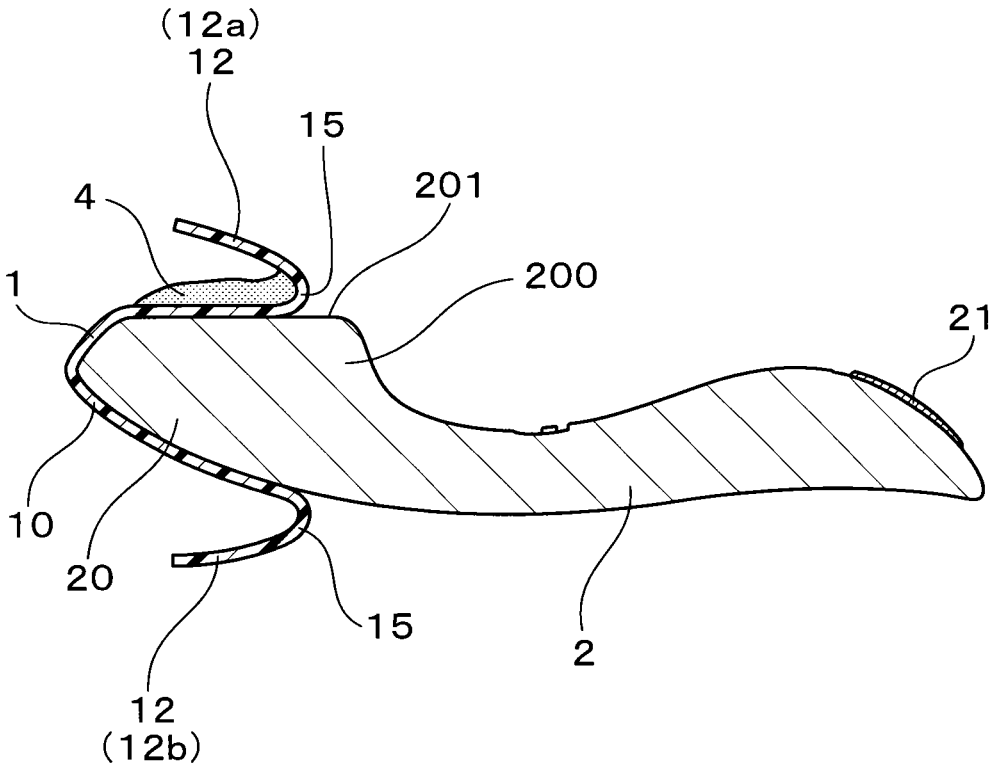
FIG. 5 is a sectional view showing the cover in the process of being turned inside out according to Example 1.

As shown in FIG. 3 and FIG. 4, the cover 1 is formed by overlaying two sheets 3 (3*a* and 3*b*) having same shape and joining part of peripheries of the sheets. As shown in FIG. 4, each of the two sheets 3 is shaped as a connection of a main body region A which is to become the cover body 10 and a holding region B which is to become the holding portion 12.

As shown in FIG. 4, the outer peripheries of the main body regions A of the two sheets 3 are arc-shaped. Also, the two sheets 3 are joined only outer peripheries 30 of the main body regions A. Consequently, as shown in FIG. 3 and FIG.

4, the open end 11 of the cover 1 is formed on a boundary C between the main body regions A and holding regions B of the two sheets 3, i.e., on a straight line connecting both ends of a joining portion (outer peripheries 30) of the main body regions A described above.

Also, as shown in FIG. 4, the holding region B of each of the two sheets 3 is elongated from the boundary C between the main body region A and holding region B toward the side opposite to the main body region A and configured to narrow in width gradually toward a tip. Also, the tip of the holding region B has a substantially semicircular shape. The cover 1 has two holding portions 12 (12*a* and 12*b*) which are formed as described above.

The sheets 3 are made of metallocene low-density polyethylene which is 0.05 mm thick in the thickest part. Thus, the cover 1 has stretchability as well as sufficient flexibility to allow the cover 1 to be turned inside out and is configured to become stretched when the attraction head 20 is covered, as described later.

Also, one surface of the sheet 3 is embossed and a large number of small columnar projections (not shown) are provided upright in a thickness direction. Consequently, the surface of the sheet 3 is a convexo-concave surface and another surface of the sheet 3 is a smooth surface. By overlaying the above-described two sheets 3 on each other with the convexo-concave surfaces facing inward, the cover 1 is configured such that an inner surface 13 shown in FIG. 3 will be made up of the convexo-concave surface while an outer surface 14 are made up of the smooth surface.

Next, the remover 2 to which the cover 1 is attached will be described. Regarding the direction of the remover 2, it is assumed in the following that along the longitudinal direction, the direction toward an end portion at which the attraction head 20 is located will be referred to as a front direction and the opposite direction will be referred to as a rear direction, unless otherwise specified. Also, the direction toward the location of the magnetic force generating surface 201 will be referred to as a lower direction and the opposite direction will be referred to as an upper direction. Also, the direction orthogonal to both the front-rear direction and upper-lower direction may be referred to as a lateral direction. These directional expressions are merely for convenience and are not related to the actual direction of the remover 2 during use.

As shown in FIG. 1 and FIG. 5, the remover 2 to which the cover 1 is attached is formed by being curved such that an approximate middle portion in the front-rear direction (longitudinal direction) will be located higher than both end portions thereof when viewed from a lateral direction. Also, as shown in FIG. 2, the both end portions of the remover 2 are substantially arc-shaped in outline when viewed in the upper-lower direction. Also, the middle portion of the remover 2 in the longitudinal direction is configured to be narrower in width than the both ends when viewed in the upper-lower direction.

As shown in FIG. 2 and FIG. 5, the attraction head 20 placed on a tip side of the remover 2 that is covered by the cover body 10 includes a bulging portion 200 bulged out in a direction substantially orthogonal to the longitudinal direction of the remover 2 (lower direction). Also, the bulging portion 200 has the magnetic force generating surface 201 made up of a flat surface on top part.

Also, the remover 2 of the present example has a first electrode 21 and second electrode 22 on its peripheral side surface. As shown in FIG. 2, the first electrode 21 is disposed in a rear end portion of the remover 2 with an electrode surface facing downward. As shown in FIG. 1, the second electrode 22 is disposed in upper part of the attraction head 20, i.e., on the side opposite the magnetic force generating surface 201.

Also, the remover 2 of the present example is configured as an ion introducer adapted to infiltrate a charged beautifying component applied to human skin into the skin using a potential difference between the first electrode 21 and second electrode 22. That is, the remover 2 is configured to be able to infiltrate the charged beautifying component applied to human skin into the skin by generating the potential difference between the first electrode 21 and second electrode 22. Also, the remover 2 of the present example is configured to be able to generate the potential difference between the first electrode 21 and second electrode 22 when both the first electrode 21 and second electrode 22 touch a human body.

Next, an example of how to use the cover 1 will be described. The user applies a paste-like cosmetic agent 4 beforehand to a skin surface on which the user wants to get a beauty effect. Then, when the cosmetic agent 4 is removed, the user inserts the attraction head 20 through the open end 11 of the cover 1 by turning one sheet 3*a* downward (toward the side of the magnetic force generating surface 201) and the other sheet 3*b* upward that the two sheets 3 making up the cover 1, and attaches the cover 1 to the attraction head 20.

When the cover 1 is attached to the attraction head 20, the holding portion 12*a* provided on the sheet 3*a* and the holding portion 12*b* provided on the other sheet 3*b* are placed on opposite sides of the remover 2 in the upper-lower direction as shown in FIG. 1. Also, as shown in FIG. 2, the main body region A of the sheet 3*a* on the lower side is placed so as to cover the magnetic force generating surface 201. At this time, the respective main body regions A of the sheets 3*a* and 3*b* are in a stretched state in which they are more stretched along the attraction head 20 including the bulging portion 200 than in natural state. That part of the main body region A of the sheet 3*a* which abuts the magnetic force generating surface 201 becomes a substantially flat surface.

Next, the user brings the attraction head 20 of the remover 2 with the cover 1 attached thereto close to the skin surface to which the cosmetic agent 4 has been applied. Consequently, the cosmetic agent 4 is attracted to a surface of the cover body 10 covering the magnetic force generating surface 201, by the magnetic force of the magnetic force generating surface 201. At this time, the cover body 10 is held between the attracted cosmetic agent 4 and magnetic force generating surface 201 by the magnetic force and kept in contact with the magnetic force generating surface 201 of the attraction head 20.

To dispose of the cosmetic agent 4 attracted to the surface of the cover body 10 as described above, the user folds back the two holding portions 12*a* and 12*b* toward the tip side of the attraction head 20. Since the cosmetic agent 4 is attracted by the magnetic force from the magnetic force generating surface 201, the remover 2 may be oriented in any direction when folding back the holding portions 12. However, from the perspective of reducing scattering of the cosmetic agent 4, the magnetic force generating surface 201 is preferably facing upward.

Next, the user displaces the holding portions 12*a* and 12*b* alternately in the direction of tip of the of the attraction head 20 and turns the cover body 10 inside out by stripping the cover body 10 from the attraction head 20 as shown in FIG. 5. Consequently, the attracted cosmetic agent 4 is gathered in a fold 15 formed between that part of the cover body 10 which has been stripped from the attraction head 20 and that part of the cover body 10 which is in contact with the magnetic force generating surface 201.

Then, when the user finishes turning the cover body 10 inside out by continuing to displace the holding portions 12 in the direction of the tip of the attraction head 20, the cosmetic agent 4 is received in the cover body 10. The cosmetic agent 4 received in the cover body 10 in this way can be discarded at a disposal site for cosmetic agent 4 with being contained in the cover 1. Note that the cover body 10 can be turned inside out with the tip of the attraction head 20 facing upward.

Next, effects of the present example will be described. As shown in FIG. 1, the cover 1 is configured to allow itself to be detachably attached to the attraction head 20 and formed into the shape of a bag which lends itself to being turned inside out. This makes it possible to suppress inadvertent scattering such that the cosmetic agent 4 removed from skin by the remover 2 leaks out of the cover.

Also, as shown in FIG. 4, each of the two sheets 3 making up the cover 1 is shaped as a connection of the main body region A which is to become the cover body 10 and the holding region B which is to become the holding portion 12. As shown in FIG. 3, only the outer peripheries 30 of the main body regions A are joined together and the two holding portions 12 are provided thereon. Thus, by displacing each of the two holding portions 12 in the direction of the tip of the attraction head 20, the cover 1 can be turned inside out more easily when stripped from the attraction head 20. This makes the cover 1 easier to use.

Also, the cover body 10 has stretchability and is configured to be stretched when the attraction head 20 is covered. Therefore, the cover body 10 is shaped to conform to the external shape of the attraction head 20, making it less likely that gaps will be formed between the cover body 10 and attraction head 20 due to creases or the like. Thus, the cover 1 can suppress weakening of the magnetic force acting on the cosmetic agent 4 by gaps described above and make the cosmetic agent 4 attracted reliably.

Also, the cover 1 is configured such that the inner surface 13 will be made up of the convexo-concave surface while the outer surface 14 are made up of the smooth surface. This allows the cover body 10 to appropriately reduce frictional forces when the attraction head 20 is inserted. Consequently, the cover 1 can be attached to the attraction head 20 more easily. Since the convexo-concave surfaces are also formed on the holding portions 12, fingers of the user are less likely to slip over the holding portions 12, making the cover 1 easier to use.

Also, the attraction head 20 that is covered by the cover body 10 includes the bulging portion 200 bulged out in the lower direction of the remover 2 and the magnetic force generating surface 201 is provided on the top part of the bulging portion 200. Consequently, the area of the magnetic force generating surface 201 on the remover 2 can be increased more easily than when the magnetic force generating surface 201 is formed on the tip surface of the remover 2 in the longitudinal direction. This increases the amount of cosmetic agent 4 attracted by the magnetic force generating surface 201. Thus, the application of the cover 1 to the remover 2 makes it possible to more effectively provide the effect of preventing inadvertent scattering of the cosmetic agent 4.

Also, the cover 1 is formed by laying two sheets 3 one on top of the other and joining part of the peripheries of the sheets 3. This results in a reduced price and more increased productivity of the cover 1 as described above.

Also, the outer peripheries of the main body regions A of the two sheets 3 are arc-shaped. Therefore, when the cover 1 is attached to the attraction head 20, turned inside out, or the like, the cover 1 is shaped such that stresses resulting from deformation of the cover 1 are less likely to concentrate on a joining area (outer peripheries 30) of the sheets 3. Thus, when the cover 1 is attached, detached, or the like, the cover 1 is less likely to being torn and less likely to cause leakage of the cosmetic agent 4.

In this way, the cover 1 is configured to allow itself to be detachably attached to the attraction head 20 and formed into the shape of a bag which lends itself to being turned inside out. This makes it possible, as described above, to suppress inadvertent scattering of the cosmetic agent 4 removed from skin by the remover 2 and thereby improve the ease of use of the remover 2.

Note that when the remover 2 of the present example is used as the ion introducer, the remover 2 can be used as follows. Before using the remover 2, the user applies the charged beautifying component to skin in advance. If the charged beautifying component may not be attracted by the magnetic force, it can be mixed with the cosmetic agent 4 in advance. In that case, after the cosmetic agent 4 is removed from the skin surface by the remover 2, the beautifying component remains on the skin surface in an applied state. As the beautifying component, L-ascorbic acid-2-sodium phosphate can be used, for example.

The user grips the remover 2 in such a way that the first electrode 21 protrudes from the hand and that the second electrode 22 touches the hand. Then, by gripping the remover 2 in this way, the user brings the first electrode 21 into contact with a skin surface. The remover 2 generates a potential difference between the first electrode 21 and second electrode 22 when the two electrodes touch the skin surface. Consequently, an ion introduction current flows through the skin surface from the first electrode 21, and the beautifying component infiltrates into the skin as a result.

Example 2

Figure 6:
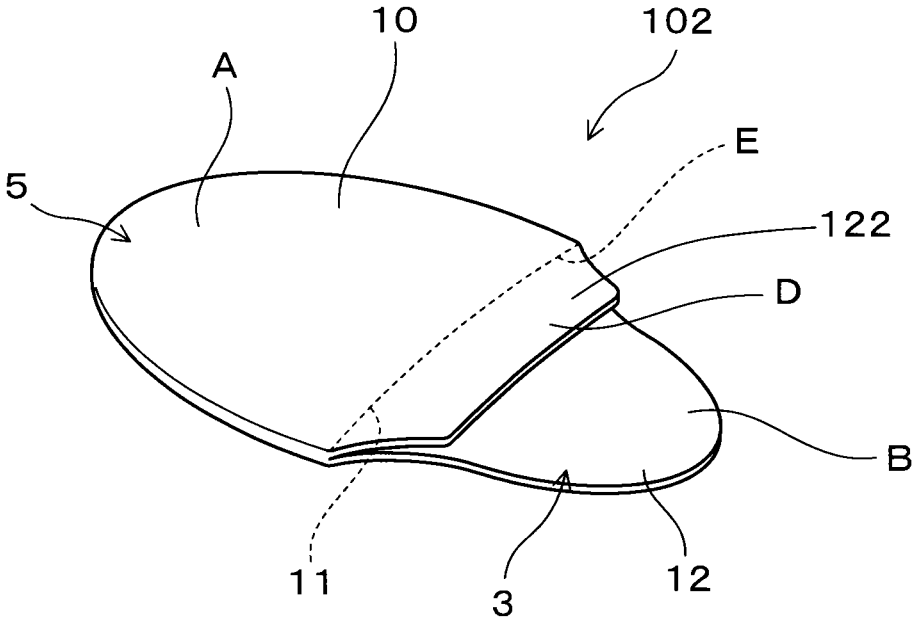
FIG. 6 is a perspective view of a cover in which holding portions of different shapes are formed on two sheets, respectively, according to Example 2.

A cover 102 of the present example is an example having a holding portion 122 differing in shape from the other sheet, in one sheet of the cover 1 according to Example 1. As shown in FIG. 6, the cover 102 is formed by overlaying a sheet 5 on the sheet 3 according to Example 1, where the sheet 5 has a holding region D different in shape from that of the sheet 3. Note that the cover 102 has a cover body 10 of the same shape as Example 1.

The sheet 5 is shaped as a connection of a main body region A of the same shape as that of the sheet 3 and the holding region D shorter in length in a elongating direction than the holding region B of the sheet 3. The holding region D is configured to narrow in width gradually toward the side opposite the main body region A. Also, a tip of the holding region D is formed into a straight line substantially parallel to a boundary E between the main body region A and holding region D. Note that the boundary E is set as a straight line connecting both ends of the joining portion of the main body regions A as with Example 1. The rest is similar to Example 1.

As shown in FIG. 6, in the cover 102 of the present example, a tip portion of the holding portion 122 consisting of the holding region D of the sheet 5 is located closer to the open end 11 than a tip portion of the holding portion 12 consisting of the holding region B of the sheet 3. In this way, the shape of the holding portion is not particularly limited, and effects similar to Example 1 can be achieved as long as a holding portion is formed on each of the two sheets. Note that the cover 102 of the present example may be attached to the attraction head 20 either such that the sheet 3 will abut the magnetic force generating surface 201 or such that the sheet 5 will abut the magnetic force generating surface 201. From the perspective of reducing scattering of the cosmetic agent 4, preferably the cover 102 is attached to the attraction head 20 such that the sheet 3 will abut the magnetic force generating surface 201.

Example 3

Figure 7:
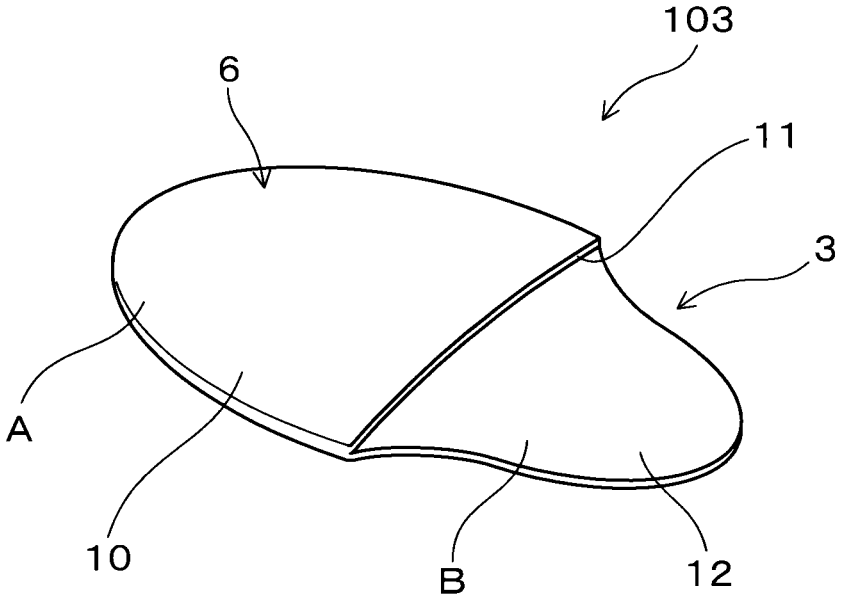
FIG. 7 is a perspective view of a cover in which a holding portion is formed only on one sheet, according to Example 3.

A cover 103 of the present example is an example in which a sheet made up of only the main body region A is used in place of one of the sheets of the cover 1 according to Example 1. As shown in FIG. 7, the cover 103 is formed by overlaying a sheet 6 made up of only the main body region A on the sheet 3 according to Example 1. Consequently, the cover 103 includes a cover body 10 of the same shape as Example 1 and one holding portion 12 extending from the cover body 10. The rest is similar to Example 1.

Preferably the cover 103 is attached to the attraction head 20 such that the sheet 3 will abut the magnetic force generating surface 201. Consequently, in turning the cover 103 inside out, a fold 15 can be formed earlier on the side of the magnetic force generating surface 201 to which the cosmetic agent 4 has been attracted than on the opposite side. Note that in this case, the sheet 6 is folded back automatically as the sheet 3 goes on being folded back.

In this way, it is sufficient if one or more holding portions 12 are provided on the remover cover 1, and then the holding portion(s) 12 can be folded back by being stripped from the attraction head 20.

Note that although examples of covers formed by joining two sheets have been shown in Examples 1 to 3, this is not restrictive. For example, if a flexible plastic sheet material is formed into a cylindrical shape with one end closed, a resulting cover provides effects similar to Example 1.

Also, the shapes of the cover body 10 and holding portion 12 are not limited to those examples described above as long as the cover body 10 is shaped to be able to cover the magnetic force generating surface 201 as well as shaped to allow itself to be turned inside out.

The invention claimed is:

1. A remover cover detachably attached to an attraction head equipped at one end of a substantially rod-shaped remover, the attraction head comprising a magnetic force generating surface adapted to generate a magnetic force, the remover cover comprising:

a cover body shaped like a bag and adapted to cover the remover from a tip of the attraction head to at least the magnetic force generating surface, the cover body including a top sheet and a bottom sheet, formed of a same resin film material, and joined along an outer periphery of the cover body; and a holding portion installed by extending from an open end of the cover body, wherein the cover body is configured to allow itself to be turned inside out, wherein the top sheet and the bottom sheet each have an inner surface that is a convexo-concave surface, and wherein the resin film material of the top sheet and the bottom sheet is formed from polyethylene, polypropylene, nylon, polyvinyl alcohol, urethane, or silicone and a thickness of the resin film is from 0.02 to 0.2 mm.

2. The remover cover according to claim 1, wherein the cover body has stretchability and is configured to become stretched when the attraction head is covered.

3. The remover cover according to claim 1, wherein the remover cover is formed by laying the top sheet on top of the bottom sheet and joining part of peripheries of the sheets.

4. The remover cover according to claim 3, wherein each of the top sheet and the bottom sheet is shaped as a connection of a main body region which is to become the cover body and a holding region which is to become the holding portion and only outer peripheries of the main body regions are joined together and two of the holding portions are provided.

5. The remover cover according to claim 4, wherein outer peripheries of the main body regions of the top sheet and the bottom sheet are arc-shaped.

6. The remover cover according to claim 4, wherein the holding regions of the top sheet and the bottom sheet have a same shape.

7. The remover cover according to claim 6, wherein outer peripheries of the main body regions of the top sheet and the bottom sheet are arc-shaped.

8. The remover cover according to claim 3, wherein one of the top sheet and the bottom sheet is shaped as a connection of a main body region which is to become the cover body and a holding region which is to become the holding portion while the other sheet is shaped to have only the main body region, and only outer peripheries of the main body regions are joined together and one of the holding portion is provided.

9. The remover cover according to claim 1, wherein the resin film material of the top sheet and the bottom sheet is metallocene low-density polyethylene that is 0.05 mm thick in a thickest part.

10. The remover cover according to claim 1, wherein the top sheet and the bottom sheet each have an outer surface that is a smooth surface.

11. The remover cover according to claim 1, wherein the resin film material of the top sheet and the bottom sheet is metallocene low-density polyethylene.

12. The remover cover according to claim 1, wherein the resin film material of the top sheet and the bottom sheet is metallocene low-density polyethylene that is 0.05 mm or less thick.

* * * * *